US008505546B2

(12) United States Patent
Sieredzinski

(10) Patent No.: US 8,505,546 B2
(45) Date of Patent: Aug. 13, 2013

(54) METHOD AND APPARATUS FOR SEPARATING TOBACCO FROM CIGARETTE WASTE

(75) Inventor: Marek Sieredzinski, Radom (PL)

(73) Assignee: International Tobacco Machinery Poland SP. Z.O.O., Radom (PL)

( * ) Notice: Subject to any disclaimer, the term of this patent is extended or adjusted under 35 U.S.C. 154(b) by 291 days.

(21) Appl. No.: 12/870,499

(22) Filed: Aug. 27, 2010

(65) Prior Publication Data

US 2011/0220132 A1 Sep. 15, 2011

(30) Foreign Application Priority Data

Mar. 12, 2010 (PL) ..... 390691

(51) Int. Cl.
*A24C 5/36* (2006.01)
*B07B 1/08* (2006.01)
*B07B 1/52* (2006.01)

(52) U.S. Cl.
CPC ... *A24C 5/36* (2013.01); *B07B 1/08* (2013.01); *B07B 1/52* (2013.01)
USPC ..... 131/96; 131/289

(58) Field of Classification Search
CPC ..... A24B 1/00; A24B 1/04; A24C 5/00; A24C 5/32; A24C 5/36; B07B 1/08; B07B 1/28; B07B 1/52
USPC ..... 131/287, 289, 96
See application file for complete search history.

(56) References Cited

U.S. PATENT DOCUMENTS

| | | | | |
|---|---|---|---|---|
| 656,102 | A * | 8/1900 | Fjeld | 209/266 |
| 3,217,561 | A * | 11/1965 | Allgaier et al. | 74/600 |
| 3,224,451 | A | 12/1965 | Dearsley | |
| 4,322,289 | A * | 3/1982 | Goncharov | 209/384 |
| 2009/0308818 | A1 * | 12/2009 | Laing | 210/744 |

FOREIGN PATENT DOCUMENTS

| | | | |
|---|---|---|---|
| GB | 327765 | A | 4/1930 |
| GB | 2 039 714 | A | 8/1980 |

OTHER PUBLICATIONS

Search Report issued by the Urzad Patentowy Rzeczypospolitej Polskiej (Patent Office of the Republic of Poland) in the corresponding Polish patent application P-390691, Apr. 19, 2010.

* cited by examiner

*Primary Examiner* — Christina Johnson
*Assistant Examiner* — Cynthia Szewczyk
(74) *Attorney, Agent, or Firm* — Browdy and Neimark, PLLC

(57) ABSTRACT

A method of separating tobacco from cigarette waste using an apparatus comprising a revolving screen, in which the cigarette waste is fed onto the screen in order to be screened by gravity. The method includes relocating the cigarette waste over the surface of the screen, the relocation being aided by a scraper unit cooperating with the screen and the angular position of the screen in the apparatus relative to the horizontal plane being adjustable. An apparatus is also provided for separating tobacco from cigarette waste comprising a revolving screen which is adjustably mounted in such a way that the angular position of the screen in the apparatus relative to the horizontal plane is adjustable, provided with a scraper unit for aiding relocation of the cigarette waste on the surface of the screen during its rotational movement.

12 Claims, 3 Drawing Sheets

METHOD AND APPARATUS FOR SEPARATING TOBACCO FROM CIGARETTE WASTE

FIELD OF THE INVENTION

All aspects of the present invention concern the domain of separation of tobacco from cigarette waste, in particular the separation of the cigarette wrappers and filters from the tobacco which may subsequently be recycled.

STATE OF THE ART

Apparatuses for recovering tobacco from damaged or substandard cigarettes are known in the tobacco industry. These apparatuses usually comprise screens of various types, through which the tobacco is screened after having been taken out of the substandard cigarettes the paper wrappers of which were previously cut open.

The screens often have the form of multi-step e.g. multi-level screens for different fractions of tobacco. Such arrangements have large overall dimensions because the screens are located one after or one over another.

Document DE 2032706 disclosed a linear vibrating screen. The screen is long because effective screening may only be achieved when the mixture of cigarette wrappers, filters and tobacco is in contact with the screen surface. Thus, as the effectively operating screen surface constitutes just a part of the total screen surface, effective screening requires using long screens. This solution has a disadvantage of being highly degrading to the tobacco fibers that strike repeatedly against the screen surface.

Document GB 1142282 disclosed a cylinder shaped screen in which the process of tobacco waste screening is prolonged because the wrappers, filters and tobacco are continuously mixed during the operation of the screen and the resulting mixture is not separated into specific fractions. Also in this case degradation of the tobacco fibers is high due to the fact that the tobacco repeatedly falls down to the base part of the operating apparatus and strikes against the mixing vanes.

Document DE 803 232 disclosed a revolving screen having a horizontal rotational axis. The mixture of wrappers, filters and tobacco constituting the cigarette waste is horizontally blown onto the surface of the screen. The tobacco strips that fall into the screen meshes go through while the tobacco that is held by the screen is removed by a suction nozzle along with the wrappers and the filters. In this apparatus only a small part of the screen surface is effectively used and it further requires using additional devices in order to blow the cigarette waste onto the screen.

SUMMARY OF THE INVENTION

According to the invention there is provided a method of separating tobacco from cigarette waste using an apparatus comprising a circular revolving screen, in which the cigarette waste is fed onto the said screen in order to be screened by gravity, the method including relocation of the cigarette waste over the surface of the screen, the said relocation being aided by scraping means cooperating with the said screen and the angular position of the screen in the apparatus relative to the horizontal plane being adjustable.

According to another aspect of the invention there is provided a method of separating tobacco from cigarette waste using an apparatus comprising a circular revolving screen making also circulation movement, in which the cigarette waste is fed onto the said screen in order to be screened by gravity, the method including relocation of the cigarette waste over the surface of the screen, the said relocation being aided by scraping means cooperating with said screen and the angular position of the screen in the apparatus relative to the horizontal plane being adjustable.

In both aspects the following advantageous embodiments may be foreseen:

- the surface of the screen is preferably positioned slantwise relative to the horizontal plane and the cigarette waste is relocated over the said surface by rotating the scraping means relative to the screen around an axis which is parallel to the axis of rotation of the screen or coinciding therewith;
- the surface of the screen is preferably positioned slantwise relative to the horizontal plane and the cigarette waste is relocated over the said surface by rotating the scraping means which are fixed relative to the surface of the screen;
- the surface of the screen is preferably positioned horizontally and the cigarette waste is relocated on the said surface by rotating the scraping means relative to the screen around an axis which is parallel to the axis of rotation of the screen or coinciding therewith;
- the rotational speed of the screen and/or the angular position of its surface is preferably adjusted depending on the humidity of the cigarette waste.

According to still another aspect of the invention there is provided an apparatus for separating tobacco from cigarette waste comprising a circular revolving screen which is adjustably mounted in such a way that the angular position of the screen in the apparatus relative to the horizontal plane is adjustable, provided with scraping means for aiding relocation of the cigarette waste on the surface of the screen during its rotational movement.

Preferably, the scraping means are mounted on an axis which is parallel to the axis of rotation of the screen or coinciding therewith, the scraping means being rotatable relative to the screen.

Also preferably, the scraping means are fixedly mounted on the surface of the screen.

Preferably, the scraping means are substantially helically shaped.

Optionally, the scraping means are in the form of mutually separated slats, preferably arranged along the lines that do not intersect the centre of the screen.

The apparatus according to the invention is preferably provided with screen cleaning means preferably screen sweeping brushes.

Optionally, the apparatus is provided with screen cleaning means in the form of at least one suction or over pressure air nozzle.

The screen is preferably provided with circulation driving means, preferably in the form of three eccentric rollers disposed around the periphery of the screen, cooperating with its outer periphery.

The screen may have variable mesh size, most preferably the largest mesh being located adjacent to the axis of rotation of the screen.

According to another aspect of the invention there is provided use of a circular revolving screen adjustably mounted so that the angular position of the screen relative to the horizontal plane is adjustable, provided with scraping means for aiding relocation of the cigarette waste on the surface of the screen during its rotational movement, for separating tobacco from cigarette waste.

Advantageous Results Of The Invention

During screening in the apparatus according to the invention, the whole surface of the screen is effectively used for screening.

The tobacco fibers, both long and short, which are relatively small compared to the filters and wrappers and the bulk density of which is substantially higher, fall down the mixture e.g. on the screen surface by gravity. In the inventive solution no forces arise aiming to take the tobacco particles further up from the surface of the screen, i.e. towards the layers of the mixture having a lower bulk density. In operation, the tobacco is sliding over the surface of the screen and passing through its meshes. The scraping means for aiding relocation of the cigarette waste act in parallel to the surface of the screen which is also in parallel to the mixture layers being formed on the screen. Consequently, no mixing of the layers having different bulk densities i.e. tobacco particles, tobacco fibers or pieces of wrappers occurs in practice.

As the screen is not vibrated, the mixture of tobacco, filters and wrappers is in permanent contact with the surface of the screen which improves the effectiveness of screening and does not unnecessarily degrade the tobacco as it happens in the known vibrating devices. While the apparatus is operating, the tobacco fibers are directed towards successive edges of the rotating screen meshes. Such screens are typically made of wire, each mesh being formed by four edges. Due to the changing positions of the rotating meshes edges, the tobacco fibers slide over the edges they hit and pass through the meshes in spite of their length being larger than the mesh size. Long fibers may get rolled during the operation of the apparatus and pass through the screen meshes in such form.

The apparatus according to the invention may have a screen having variable mesh size, preferably the largest mesh being located adjacent to the axis of rotation of the screen. Gradation of the mesh size improves the effectiveness of the apparatus operation. Small strips of tobacco are screened through smaller meshes in the lower part of the screen operating surface which happens fast enough, while the long fibers may be relocated several times over the operating surface before they hit a larger mesh on their way.

DESCRIPTION OF THE EXEMPLARY EMBODIMENTS

The apparatus according to the invention is shown in non-limiting exemplary embodiments in the drawing, where:

Figure 1:
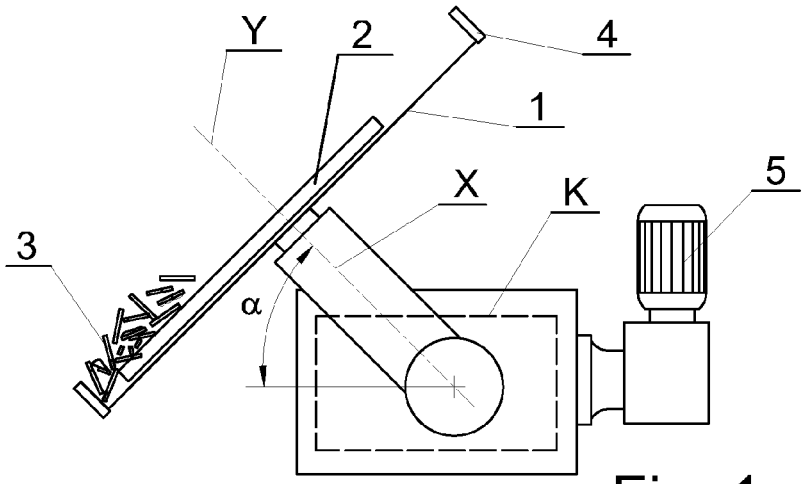
FIG. 1 shows a schematic side view of the first embodiment of the apparatus according to the invention.
Figure 2:
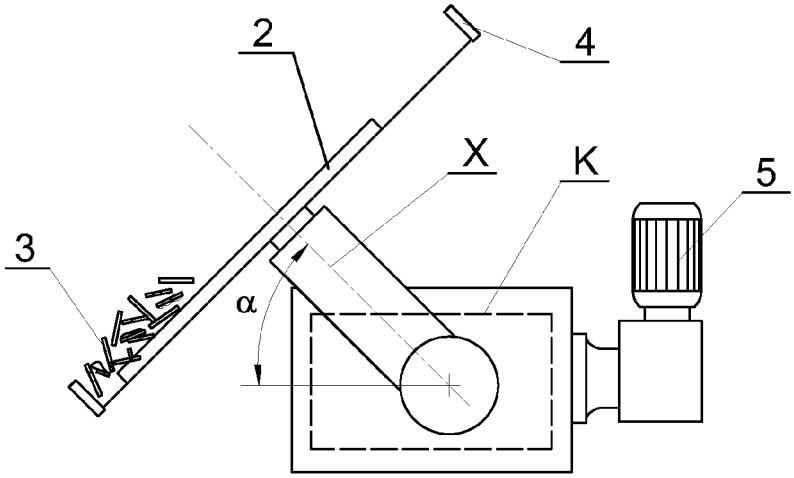
FIG. 2 shows a schematic side view of the second embodiment of the apparatus according to the invention.
Figure 3:
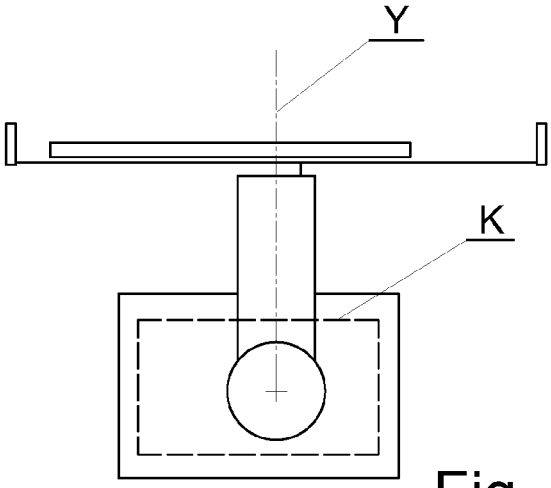
FIG. 3 shows a schematic side view of the third embodiment of the apparatus according to the invention.

The apparatus according to the invention, shown in FIG. 1, comprises a circular, revolving screen 1, mounted rotatably on a rotational axis X, the angular position of the screen surface in the apparatus relative to the horizontal plane being adjustable. The angle $\alpha$ may be adjusted depending on the humidity of the cigarette waste. To adjust the angular position of the screen surface typical means may be used that were not shown in detail in the figures and have been designated as means K. The apparatus is provided with scraping means 2 enabling relocation of the cigarette waste 3 on the surface of the screen on rotating of the screen. The screen 1 is delimited on its periphery by a wall 4. The screen and optionally the scraping means are driven in rotation by means of a motor 5, in the direction shown in the figures by an arrow. FIG. 1 shows the embodiment of he apparatus in which the scraping means 2 are rotatably mounted on the axis Y coinciding with the axis of the screen. FIG. 2 shows the embodiment of the apparatus in which the scraping means 2 are fixed to the surface of the screen 1. In the apparatus shown in FIG. 3 the screen is positioned horizontally and the scraping means 2 are rotatably mounted on the axis Y and move relative to the surface of the screen 1. In the embodiment where the scraping means 2 are rotatably mounted on the axis Y coinciding with the axis of the screen or parallel to the axis of the screen, they may be rotated with the same rotational speed as the screen or with a different rotational speed. Hence, even with the scraping means independently rotating over the screen, it is possible to keep them immovable relative to the surface of the screen.

Figure 4:
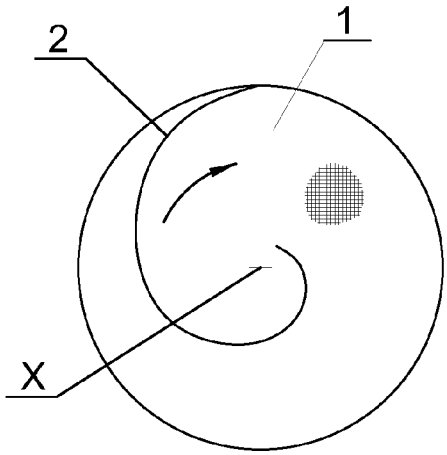
FIGS. 4-8 show schematic views from above of the screens with different kinds of scraping means.
Figure 7:
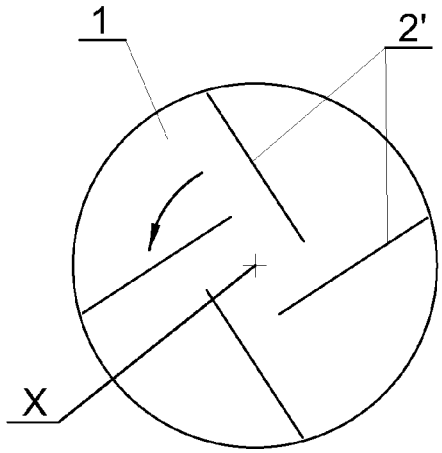
Figure 5:
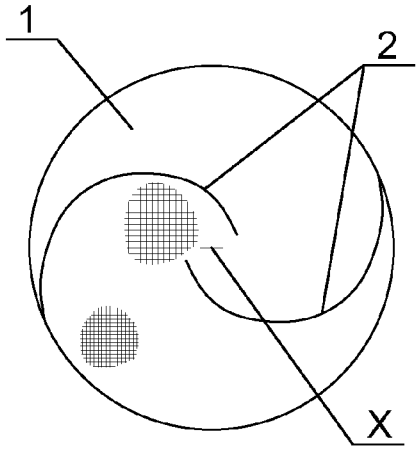
Figure 8:
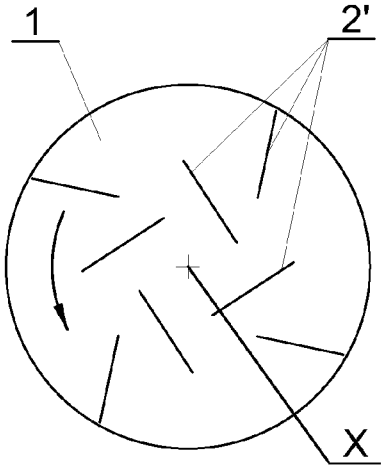

FIGS. 4 and 5 show various examples of the possible arrangements of the scraping means 2, 2' in the form of low walls positioned substantially perpendicularly to the surface of the screen and having a spiral shape. Optionally, they may have the form of mutually separated slats arranged along lines that do not go through the center of the screen. The slats may e.g. be straight as shown on FIG. 7 and FIG. 8. FIG. 5 additionally shows the larger mesh sizes located adjacent to the axis of the screen.

Figure 6:
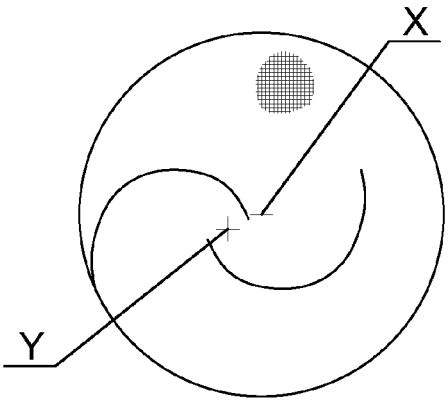

FIG. 6 shows an example of the scraping means 2 rotatably mounted on the axis Y which is parallel to the axis of the screen and not coinciding therewith.

Figure 9:
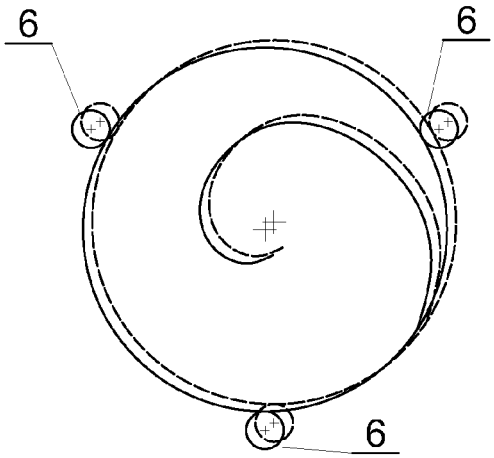
FIG. 9 shows a schematic view from above of the screen with circulation driving means.

FIG. 9 shows a schematic view of the screen with circulation driving means in the form of three eccentric rollers 6 cooperating with the outer periphery of the screen. In this embodiment the screen is mounted rotatably by typical means enabling its circulation movement. The eccentric rollers 6 drive the screen in circulation movement in addition to the rotation. FIG. 9 shows two momentary positions of the screen during its movement, one being shown with a continuous line and the other with a dashed line. The cigarette waste located on the screen is additionally relocated in parallel to the surface of the screen which improves the effectiveness of the screening.

Figure 10:
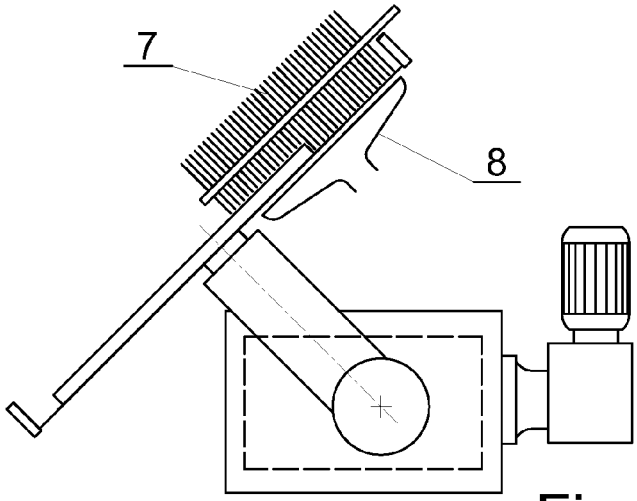
FIG. 10 shows a schematic side view of the apparatus according to the invention provided with screen cleaning means.
Figure 11:
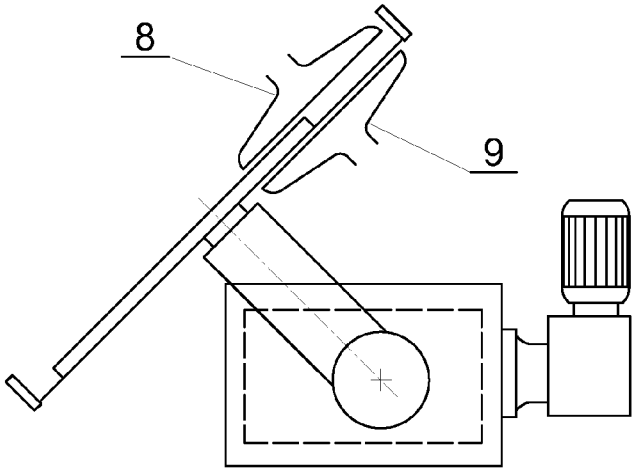
FIG. 11 shows a schematic side view of the apparatus according to the invention provided with another screen cleaning means.
Figure 12:
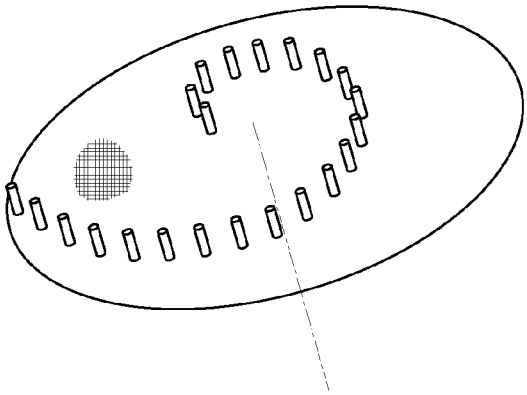
FIG. 12 shows an embodiment of the screen having the scraping means in the form of slats perpendicularly fixed to the surface of the screen, arranged along a spiral line.

FIGS. 10 and 11 show a schematic side view of the apparatus according to the invention provided with screen cleaning means in the form of a brush 7 sweeping the screen and one suction nozzle 8—FIG. 10, and in the form of one suction nozzle and one over pressure nozzle—FIG. 11. FIG. 12 shows an embodiment of the screen having the scraping means in the form of the slats that are perpendicularly fixed to the surface of the screen, arranged along a spiral line.

The cigarette waste is thrown onto the operating surface of the screen 1 of the apparatus for separating tobacco from wrappers and filters. After the apparatus has been turned on, the screen 1 is rotated and the scraping means 2, aiding to relocate the cigarette waste 3 move along with the screen. Means 2 may rotate with the same rotational speed as the screen or with a different rotational speed. The function of the scraping means 2 is to relocate the cigarette waste 3 in such a way that it is distributed all the time on the largest possible area of the screen surface 1. It means that in the case of the circular revolving screen 1 positioned slantwise relative to the horizontal plane, at a given moment of the rotations of the screen, both the lower part of the screen surface and its upper part are operatively effective, i.e. both parts are in contact with the cigarette waste 3. Before being fed to the screen 1, the cigarette waste 3 undergoes a treatment consisting in cutting open the cigarette paper being cigarette wrapper, while the tobacco is taken out from the cigarettes on the screen. During operation of the apparatus, the mixture of cigarettes, cigarette wrappers and filters is divided into the fractions having different bulk density. The function of the scraping means 2 is to relocate first of all the fraction of the cigarette waste 3 located closest to the screen surface, i.e. the tobacco and the cigarettes that have not yet been emptied. The fractions having low bulk density, like big pieces of the wrappers or filters with pieces of wrappers stuck on are not as much relocated as the tobacco and the full cigarettes. The scraping means 2 may be rotatably mounted on the axis Y independently on the axis X of the screen in such a way that they may be rotated with a speed synchronized with the rotational speed of the screen. It is also obtainable to rotate the scraping means 2 with a different rotational speed than the rotational speed of the screen which would result in that the scraping means 2 would be additionally sweeping the screen surface. In such a case, the scraping means 2 are functional also when the surface of the screen is positioned horizontally.

In another embodiment of the invention, shown on FIG. 2, the scraping means 2 are fixed to the screen surface. Here, the scraping means 2 are functional only when the surface of the screen is positioned slantwise. The cigarette waste 3 located on the screen, tending to fall down by gravity is simultaneously "taken up" by the scraping means 2 rotating along with the screen and relocating the waste on the screen surface.

The apparatus according to the invention is provided with typical means for adjusting the angular position of the screen and the means for changing its rotational speed. The screen used in the apparatus may have radially variable mesh size.

The invention claimed is:

1. An apparatus for separating tobacco from cigarette waste comprising a revolving screen having a bottom surface by which the screen is mounted in the apparatus at an acute angle relative to the horizontal plane, the screen further having a top surface, the angular position of the screen with respect to a horizontal plane being adjustable and the screen being provided with scraping unit on the top surface of the screen for aiding relocation of the cigarette waste on the top surface of the screen during its rotational movement.

2. The apparatus according to claim 1, in which the scraping unit is mounted on an axis which is parallel to the axis of rotation of the screen or coinciding therewith, the scraping unit being rotatable relative to the screen.

3. The apparatus according to claim 1, in which the scraping unit is fixedly mounted on the surface of the screen.

4. The apparatus according to claim 1 or 2 or 3, in which the scraping unit is substantially helically shaped.

5. The apparatus according to any of the claim 1 or 2 or 3, in which the scraping unit is in the form of mutually separated slats.

6. The apparatus according to claim 1, provided with screen cleaning unit.

7. The apparatus according to claim 6, in which the screen cleaning unit comprises a screen sweeping brushes or at least one suction or over pressure air nozzle.

8. The apparatus according to claim 1, in which the screen is provided with circulation driving unit.

9. The apparatus according to claim 8, in which the circulation driving unit comprises eccentric rollers disposed around the periphery of the screen, cooperating with its outer periphery.

10. The apparatus according to claim 1, in which the screen has variable mesh size.

11. The apparatus according to claim 10, in which the largest mesh is located adjacent to the axis of rotation of the screen.

12. The apparatus according to claim 1, in which the revolving screen has a circular shape.

* * * * *